US009062513B2

(12) United States Patent
Pallini, Jr. et al.

(10) Patent No.: US 9,062,513 B2
(45) Date of Patent: Jun. 23, 2015

(54) EXTERNAL HYDRAULIC TIEBACK CONNECTOR

(75) Inventors: Joseph W. Pallini, Jr., Tomball, TX (US); Steven Wong, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 1440 days.

(21) Appl. No.: 12/492,340

(22) Filed: Jun. 26, 2009

(65) Prior Publication Data

US 2009/0322074 A1 Dec. 31, 2009

Related U.S. Application Data

(60) Provisional application No. 61/075,809, filed on Jun. 26, 2008.

(51) Int. Cl.
*E21B 33/038* (2006.01)

(52) U.S. Cl.
CPC ..... *E21B 33/038* (2013.01)

(58) Field of Classification Search
USPC ..... 285/84, 87, 101, 298, 301–302, 320, 285/314–315, 34–35, 920
See application file for complete search history.

(56) References Cited

U.S. PATENT DOCUMENTS

| | | | | | |
|---|---|---|---|---|---|
| 2,552,543 | A | * | 5/1951 | Earle et al. | 285/277 |
| 2,708,589 | A | * | 5/1955 | Masek | 285/277 |
| 3,222,088 | A | * | 12/1965 | Haeber | 285/18 |
| 3,552,507 | A | * | 1/1971 | Brown | 175/258 |
| 4,345,649 | A | * | 8/1982 | Baugh et al. | 166/120 |
| 4,375,240 | A | * | 3/1983 | Baugh et al. | 166/387 |
| 4,441,559 | A | * | 4/1984 | Evans et al. | 166/382 |
| 4,496,172 | A | * | 1/1985 | Walker | 285/18 |
| 4,664,188 | A | * | 5/1987 | Zunkel et al. | 166/134 |
| 5,566,761 | A | | 10/1996 | Pallini, Jr. et al. | |
| 5,971,076 | A | * | 10/1999 | Taylor et al. | 166/368 |
| 6,234,252 | B1 | | 5/2001 | Pallini, Jr. et al. | |
| 6,260,624 | B1 | | 7/2001 | Pallini, Jr. et al. | |
| 6,293,343 | B1 | * | 9/2001 | Pallini et al. | 166/345 |
| 6,474,696 | B1 | * | 11/2002 | Canale | 285/7 |
| 6,540,024 | B2 | | 4/2003 | Pallini et al. | |
| 7,234,528 | B2 | | 6/2007 | Pallini, Jr. et al. | |

FOREIGN PATENT DOCUMENTS

| | | | |
|---|---|---|---|
| GB | 2335684 | A | 9/1999 |
| GB | 2340572 | A | 2/2000 |
| GB | 2362906 | A | 12/2001 |

* cited by examiner

*Primary Examiner* — Aaron Dunwoody
*Assistant Examiner* — Fannie Kee
(74) *Attorney, Agent, or Firm* — Bracewell & Giuliani LLP

(57) ABSTRACT

A connector for tie back liners has a tubular housing having at least one interior locking dog window. A setting chamber having a setting piston is located in the housing. A retraction chamber is in the housing, spaced axially from the setting chamber and having a retracting piston. Locking dogs are movably coupled in the locking dog window and axially spaced between the setting chamber and the retraction chamber. An actuating sleeve has a cam surface in engagement with the locking dogs and end portions with the setting piston and the retracting piston. Linking elements are in engagement with the locking dogs and a load shoulder located in the housing. The linking elements extend through linking element windows in the actuating sleeve. A shock absorber on the end of the housing absorbs shock when the connector lands on a wellhead.

22 Claims, 7 Drawing Sheets

EXTERNAL HYDRAULIC TIEBACK CONNECTOR

CROSS REFERENCE TO RELATED APPLICATIONS

This application claims the benefit of the filing date of U.S. provisional patent application Ser. No. 61/075,809, filed on Jun. 26, 2008, the disclosure of which is incorporated herein by reference.

FIELD OF THE INVENTION

This invention relates in general to offshore drilling and well production equipment, and in particular to connectors for tieback external risers.

DETAILED DESCRIPTION OF THE EXEMPLARY EMBODIMENTS

Figure 1:
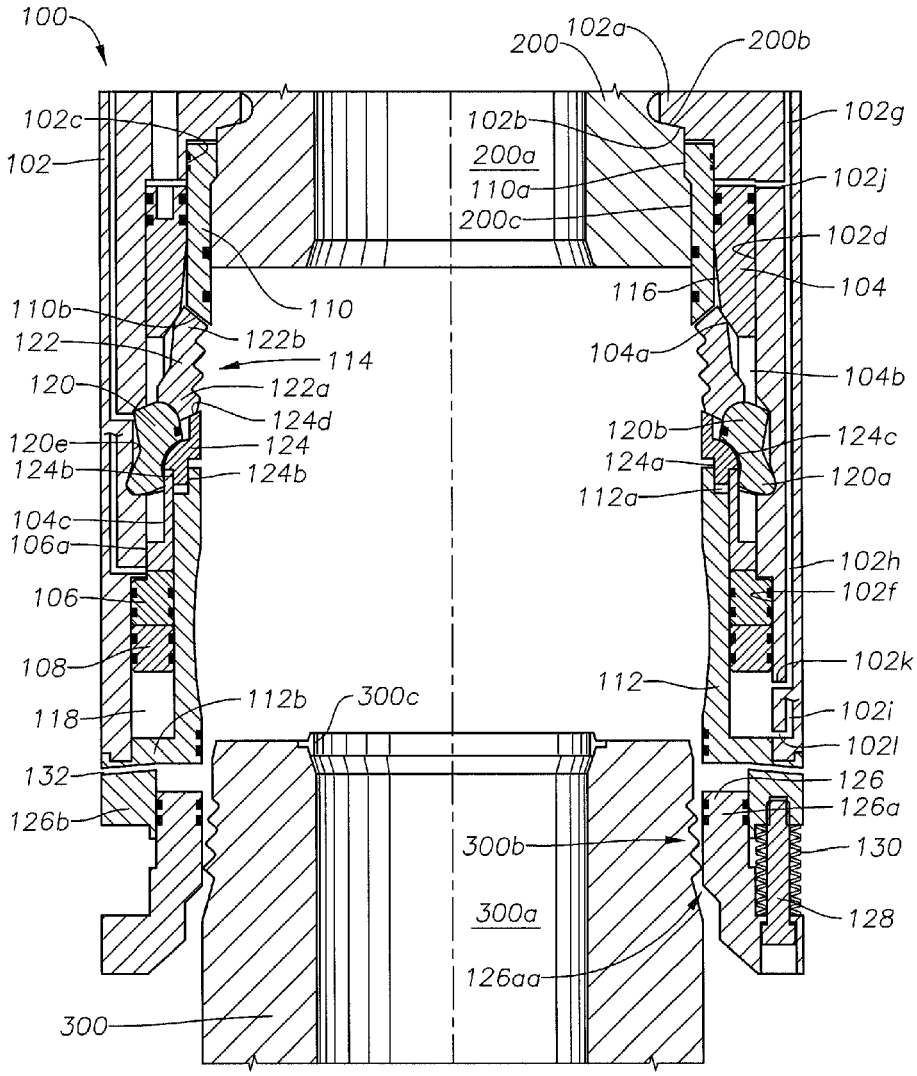
FIG. 1 is a fragmentary cross sectional illustration of an exemplary embodiment of an external hydraulic tieback connector.

In the drawings and description that follows, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, an exemplary embodiment of a tieback connector assembly 100 includes an outer tubular sleeve 102 that includes an inner flange 102*a* at one end having a stepped internal shoulder 102*b*, an annular internal recess 102*c*, an annular internal recess 102*d*, an annular recess 102*e*, and an annular internal recess 102*f* at another end. The sleeve 102 further defines a longitudinal flow passage 102*g*, a longitudinal flow passage 102*h*, a longitudinal flow passage 102*i*, a radial flow passage 102*j* that connects the longitudinal flow passage 102*g* to the internal annular recess 102*d*, a radial flow passage 102*k* that connects the longitudinal flow passage 102*h* to the internal annular recess 102*f*, and a radial flow passage 102*l* that connects the longitudinal flow passage 102*i* to a lower location within the internal annular recess 102*f*.

A tubular actuating sleeve 104 is received within and mates with the annular internal recess 102*d* of the outer tubular sleeve 102 that defines a tapered annular internal recess 104*a* at one end, a plurality of circumferentially spaced apart radial windows 104*b*, and a lower tubular end 104*c*.

A tubular piston 106 that includes an annular external recess 106*a* at one end is received within and mates with the internal annular recess 102*f* of the outer tubular sleeve 102. In an exemplary embodiment, the external annular recess 106*a* of the tubular piston 106 mates with and in received within the internal annular recess 102*d* of the outer tubular sleeve 102 and the upper end of the tubular piston 106 is threadably coupled to the lower tubular end 104*c* of the actuating sleeve 104.

A tubular piston 108 is received within and mates with the internal annular recess 102*f* of the outer tubular sleeve 102. The tubular piston 108 is also positioned proximate and below the tubular piston 106.

An inner tubular sleeve 110 includes an internal flange 110*a* at one end and an external tapered annular recess 110*b* at another end. The end of the inner tubular sleeve 110 is received within and mates with the annular internal recess 102*c* of the outer tubular sleeve 102.

An inner tubular sleeve 112 includes an external annular recess 112*a* at one end and an external flange 112*b* having a bottom channel 112*c* at another end. The bottom channel 112*c* at the other end of the inner tubular sleeve 112 receives and mates with the other end of the inner tubular sleeve 102.

The opposing ends of the inner tubular sleeves, 110 and 112, are spaced apart from one another and thereby define an annular window 114 therebetween.

The internal annular recess 102*d* of the external tubular sleeve 102 and the inner tubular sleeve 110 define therebetween an annular chamber 116 that receives one end of the tubular actuating sleeve 104 for longitudinal displacement therein. The internal annular recess 102*f* of the external tubular sleeve 102 and the inner tubular sleeve 112 define therebetween an annular piston chamber 118 that receives the tubular pistons, 106 and 108, for longitudinal displacement therein.

One side of a lower end 120*a* of a pivotable load transfer element 120 is received within the internal annular recess 102*e* of the external tubular sleeve 102 for pivoting motion relative to the external tubular sleeve. In an exemplary embodiment, a plurality of circumferentially spaced apart load transfer element elements 120 are received within the internal annular recess 102*e* of the external tubular sleeve 102 for pivoting motion relative to the external tubular sleeve. The other side of the lower end 120*a* of each load transfer element

120 is mounted for pivoting motion relative to the tubular actuating sleeve 104. One side of an upper end 120*b* of each load transfer element 120 is received within the internal annular recess 102*e* of the external tubular sleeve 102 for radial displacement relative to the external tubular sleeve. The other side of the upper end 120*b* of each load transfer element 120 extends through the corresponding circumferentially spaced apart radial window 104*b* of the tubular actuating sleeve 104 for movement therein.

A lower end 122*a* of a locking dog 122 includes a recessed curved surface that mates with an external curved surface of the upper end 120*b* of the load transfer element 120 for pivoting motion relative thereto. In this manner, a plurality of circumferentially spaced apart locking dogs 122 are provided that are operably coupled to one or more corresponding load transfer elements 120. In an exemplary embodiment, the load transfer elements 120 and the locking dogs 122 may be staggered with respect to one another in a circumferential direction. As a result, each locking dog 122 may be supported by and paired with circumferential opposing end portions of adjacent load transfer elements 120.

The lower end 122*a* of the locking dog 122 is also at least partially positioned within the corresponding circumferentially spaced apart radial window 104*b* of the tubular actuating sleeve 104 for movement therein. An upper end 122*b* of the locking dog 122 includes a tapered inner surface that mates with the tapered external annular recess 110*b* of the inner tubular sleeve 110 and a tapered outer surface that mates with the tapered annular internal recess 104*a* of the tubular actuating sleeve 104. An inner face of the locking dog 122 includes a profiled outer surface.

A retraction sleeve 124 includes an internal annular recess 124*a* at one end that mates with the external annular recess 112*a* of the inner tubular sleeve 112, an external annular recess 124*b* at the one end that mates with and receives the other end of the tubular actuating sleeve 104, a curved outer external surface 124*c* that mates with complementary curved surfaces provided on each of the load transfer elements 120, and a tapered external surface 124*d* at another end that mates with a portion of the lower ends 122*a* of each of the locking dogs 122 for retaining and retracting the lower ends of the locking dogs.

An end of a telescoping tubular guide assembly 126 is coupled to the other end of the external tubular sleeve 102 that includes an inner telescoping tubular member 126*a* having a tapered opening 126*aa* at lower end thereof and an outer tubular support 126*b* that is coupled to the other end of the external tubular sleeve. In an exemplary embodiment, the inner telescoping tubular member 126*a* of the tubular guide assembly 126 telescopes downwardly from the outer tubular support 126*b* of the tubular guide assembly such that the inner telescoping tubular member of the tubular guide assembly may be displaced in a longitudinal direction relative to the outer tubular support of the tubular guide assembly and the other end of the external tubular sleeve 102. In an exemplary embodiment, the inner telescoping tubular member 126*a* of the tubular guide assembly 126 is coupled to the outer tubular support 126*b* of the tubular guide assembly by one or more retaining bolts 128 and is spring biased away from the end of the inner telescoping tubular member of the tubular guide assembly by springs 130 positioned around each of the bolts.

Flow passages 132 are also defined within and extend through the outer tubular support 126*b* of the tubular guide assembly 126 for conveying fluidic materials therethrough. In an exemplary embodiment, the flow passages 132 further include conventional orifices for controlling the rate of fluid flow therethrough.

In an exemplary embodiment, the telescoping support 126*b* of the tubular guide assembly 126 may be provided as an outer annular extension of the lower end of the inner tubular sleeve 112.

During operation, as illustrated in FIG. 1, an upper end of the assembly 100 is coupled to a lower end of a conventional tubular liner 200 that defines an internal passage 200*a* and includes an external flange 200*b* at the lower end having a stepped external flange 200*c*. In particular, during assembly, the external flange 200*b* of the lower end of the liner 200 is received within and is coupled to the internal flange 102*a* of the external tubular sleeve 102 and the stepped external flange 200*c* of the lower end of the liner 200 is received within and is coupled to the internal flange 110*a* at the end of the inner tubular sleeve 110. In this manner, the lower end of the liner 200 is coupled to the upper end of the assembly 100 is such a manner are to prevent longitudinal displacement of the liner relative to the assembly. In an exemplary embodiment, the liner 200 provides an external riser for connection to a subsea wellhead.

After coupling the assembly 100 to the lower end of the liner 200, the assembly and liner are positioned proximate an end of a conventional wellhead 300 that defines an internal passage 300*a* and includes an external profiled surface 300*b* proximate the end of the wellhead and a tubular gasket 300*c* within an annular recess provided at the upper end of the wellhead. In an exemplary embodiment, the assembly 100 and liner 200 are then displaced toward the end of the wellhead 300 until the end of the wellhead is received within the tapered opening 122*a* of the tubular guide assembly 122. In an exemplary embodiment, the wellhead 300 is a subsea wellhead.

Figure 2:
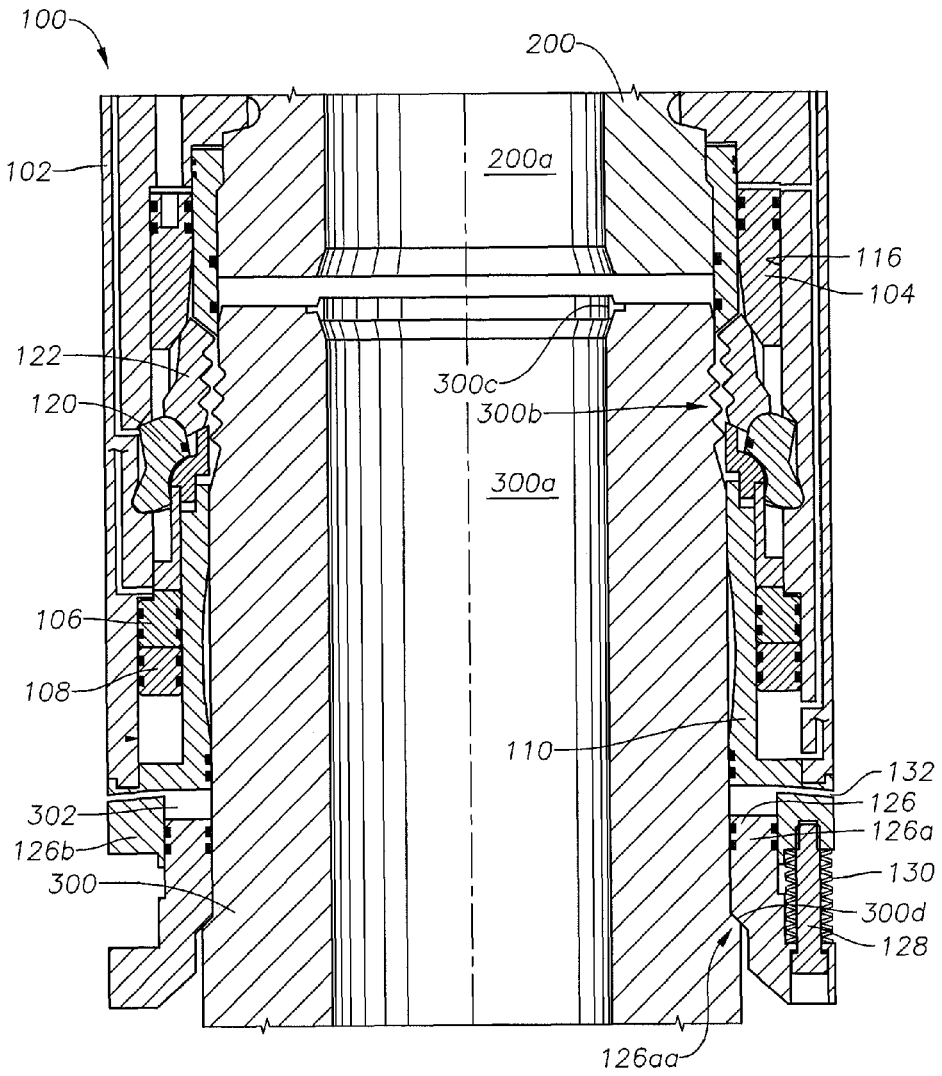
FIG. 2 is a fragmentary cross sectional illustration of an exemplary embodiment of the external hydraulic tieback connector of FIG. 1 during the landing of the connector onto a wellhead.

In an exemplary embodiment, as illustrated in FIG. 2, the assembly 100 and liner 200 are then further displaced toward the end of the wellhead 300 until the tapered opening 126*a* of the tubular guide assembly 126 engages load shoulders 300*d* provided on the wellhead. During the engagement of the tubular guide assembly 126 with the wellhead 300, an annular chamber 302 is defined by, and bounded between, the exterior surface of the wellhead and the axial annular space defined between the lower end face of the inner tubular sleeve 110, the upper end face of the inner telescoping tubular member 126*a* of the tubular guide assembly 126, and the inner surface of the outer tubular support 126*b* of the tubular guide assembly.

Figure 3:
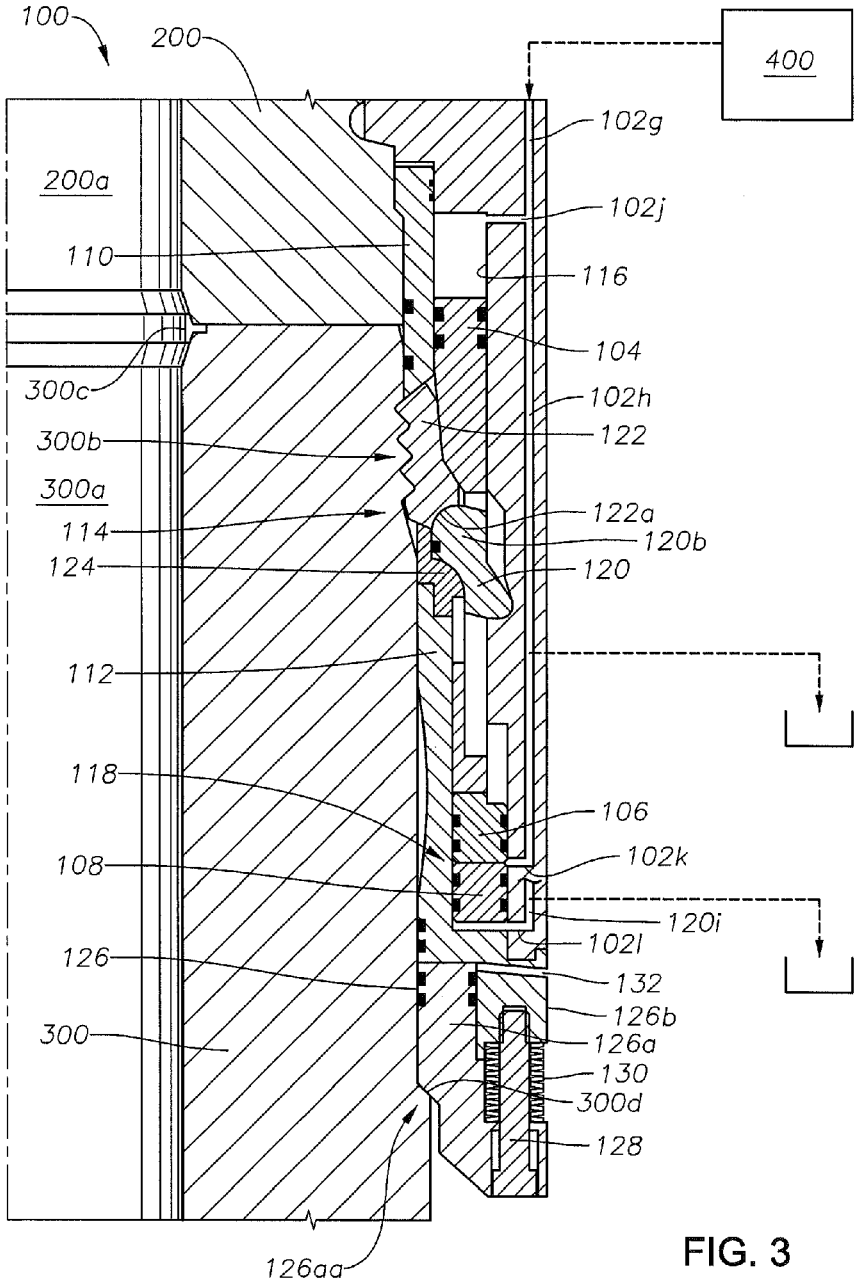
FIG. 3 is a fragmentary cross sectional illustration of an exemplary embodiment of the external hydraulic tieback connector of FIG. 2 during the locking of the connector onto the wellhead.

In an exemplary, as illustrated in FIG. 3, after the tapered opening 126*a* of the tubular guide assembly 126 engages the load shoulders 300*d* provided on the wellhead 300, the assembly 100 and liner 200 are then further displaced toward the end of the wellhead 300 until the lower end face of liner rests on the upper end face of the end of the wellhead. As a result, the tubular gasket 300*c* is compressed between the opposing open ends of the liner 200 and wellhead 300 thereby fluidicly sealing the interface therebetween. Furthermore, as a result of the further displacement of the assembly 100 and liner 200, the springs 130 of the tubular guide assembly 126 are compressed thereby permitting the inner tubular telescoping portion 126*a* of the tubular guide assembly 126 to telescope into and towards the outer tubular support portion 126*b* of the tubular guide assembly. As a result, fluidic material within the chamber 302 is exhausted out of the chamber through the passages 132. In an exemplary embodiment, the combination of the springs 130, on the one hand, and the fluidic chamber 302 and passages 132, on the other hand, provide a spring-damper shock absorber system that controllably absorbs energy and limits the rate of displacement of the inner tubular telescoping portion 126*a* relative to the outer tubular support portion 126*b* of the guide assembly 126 during the engagement of the guide assembly 126 with the wellhead 300.

In an exemplary embodiment, the energy absorbed by the springs 130, fluidic chamber 302 and passages 132, during the further displacement of the assembly 100 and liner 200 minimizes shock loads on the assembly 100, liner 200 and wellhead 300. Furthermore, as a result, energy absorbed by the springs 130, fluidic chamber 302 and passages 132, during the further displacement of the assembly 100 and liner 200 prevents damage to the gasket 300*c* thereby providing a soft landing of the end of the liner on the opposing end of the wellhead 300. Furthermore, as a result of the further displacement of the assembly 100 and liner 200, the locking dogs 122 of the assembly 100 are positioned in opposing relation to the profiled external surface 300*b* of the wellhead 300. Furthermore, as a result, energy absorbed by the springs 130, fluidic chamber 302 and passages 132, during the further displacement of the assembly 100 and liner 200 prevents distortion of the gasket 300*c* thereby preventing, for example, flattening of the vertically aligned portion of the gasket into engagement with the tapered open ends of the passages, 200*a* and 300*a*, of the liner 200 and wellhead 300, respectively.

The locking dogs 122 are then displaced into engagement with the profiled external surface 300*b* of the wellhead 300 thereby locking the lower end of the liner 200 onto the opposing end of the wellhead. In particular, a pump 400 may be operated to pump fluid into and through the passages, 102*g* and 102*j*, thereby pressurizing the portion of the annular chamber 116 above the top end face of the tubular actuating sleeve 104.

As a result of the pressurizing of the portion of the annular chamber 116 above the top end face of the tubular actuating sleeve 104, the tubular actuating sleeve is displaced in a downward direction relative to the locking dogs 122 thereby impacting and displacing the locking dogs radially inwardly through the annular window 114 into engagement with the profiled external surface 300*b* of the wellhead 300. The downward displacement of the tubular actuating sleeve 104 further causes the inner surface of the tubular actuating sleeve to surround and engage the outer surface of the locking dogs 122 thereby preventing the locking dogs from being disengaged from the profiled external surface 300*b* of the wellhead 300. In an exemplary embodiment, during the downward displacement of the tubular actuating sleeve 104, fluid is drained from the piston chamber 118 through the radial passages, 102*k* and 102*l*, into the longitudinal passages, 102*h* and 102*i*, respectively.

As illustrated in FIG. 3, during the operation of the assembly 100 to pivot and radially displace the locking dogs 122 into engagement with the profiled external surface 300*b* of the wellhead 300, the ends 122*a* of the locking dogs are supported on the ends 120*b* of the load transfer elements 120. During the operation of the assembly 100 to pivot and radially displace the locking dogs 122 into engagement with the profiled external surface 300*b*, the load transfer elements 120 provide pivoting links that swing in and out of the assembly. As a result, the load transfer elements 120 change the load angle between the assembly 100 and the locking dogs 122 while the locking dogs are displaced into engagement with the profiled external surface 300*b* of the wellhead 300. In an exemplary embodiment, the more the locking dogs 122 engage the profiled external surface 300*b* of the wellhead 300, the resistance to engagement in a radial direction also may increase. However, because the load angle between the assembly 100 and the locking dogs 122, while the locking dogs are displaced into engagement with the profiled external surface 300*b* of the wellhead 300, increases within increasing engagement, the increased load angle provides increased inward radial force to assist the engagement of the locking dogs with the profiled external surface of the wellhead.

Figure 4:
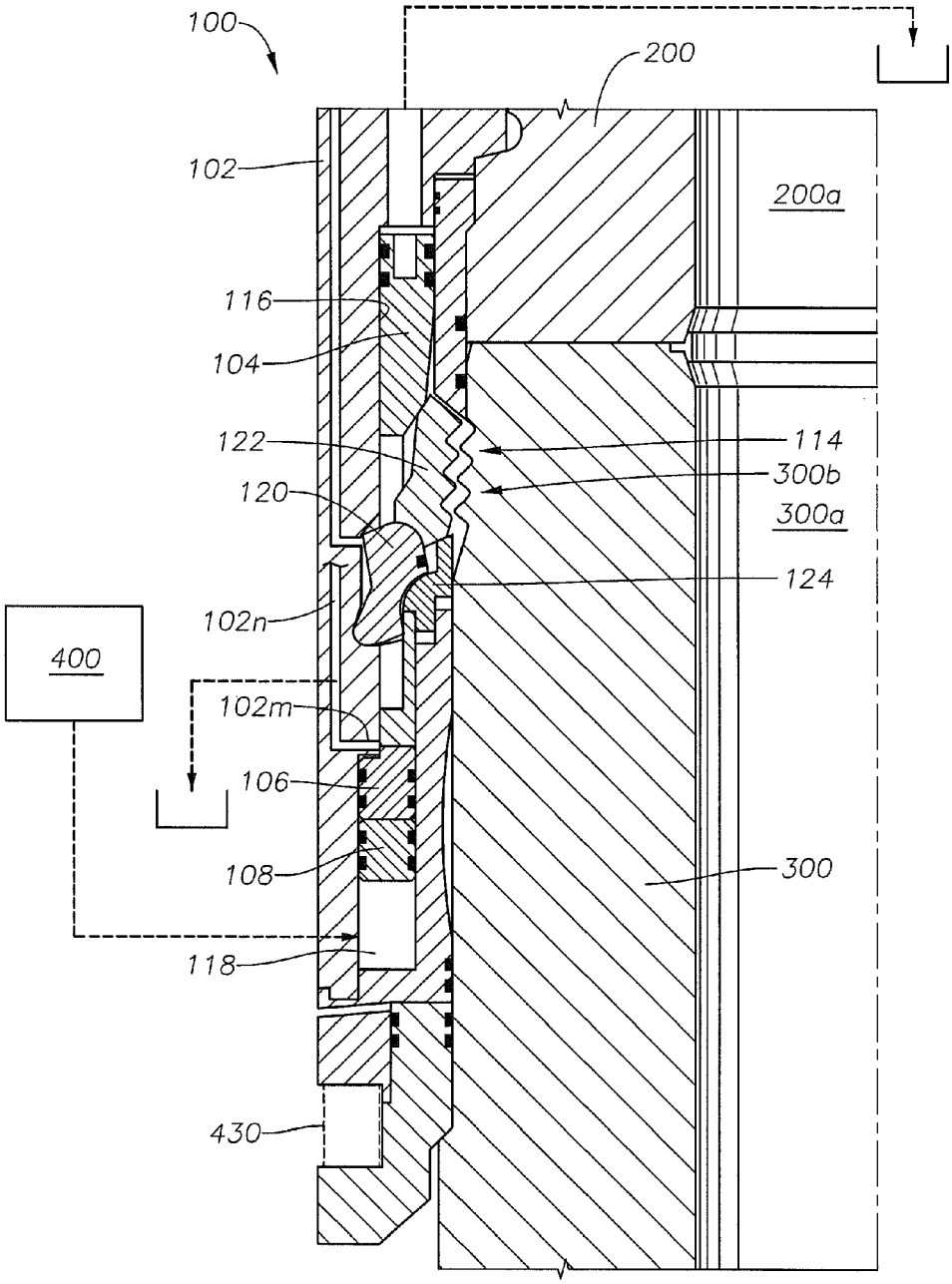
FIG. 4 is a fragmentary cross sectional illustration of an exemplary embodiment of the external hydraulic tieback connector of FIG. 3 during the unlocking of the connector from the wellhead.

Referring now to FIG. 4, in an exemplary embodiment, the locking dogs 122 may be disengaged from the profiled external surface 300*b* of the wellhead 300 by displacing the tubular actuating sleeve 104 upwardly relative to the locking dogs. In particular, the pump 400 may be operated to pump fluid into and through the passages, 102*i* and 102*l*, thereby pressurizing the portion of the annular chamber 118 below the tubular pistons, 106 and 108. In an exemplary embodiment, during the pressurizing of the portion of the annular chamber 118 below the tubular pistons, 106 and 108, fluid is drained from the portion of the annular chamber 118 above the tubular pistons, 106 and 108, through passages, 102*m* and 102*n*, defined in the tubular sleeve 102 and fluid is drained from the annular chamber 116 through the passages, 102*g* and 102*j*.

As a result of the pressurizing of the portion of the annular chamber 118 below the tubular pistons, 106 and 108, the pistons and the tubular actuating sleeve 104 are displaced in an upward direction relative to the locking dogs 122 thereby permitting the locking dogs to be displaced radially outwardly through the annular window 114 out of engagement with the profiled external surface 300*b* of the wellhead 300. The upward displacement of the tubular actuating sleeve 104 further causes the inner surface of the tubular actuating sleeve to no longer surround and engage the outer surface of the locking dogs 122 thereby permitting the locking dogs to be disengaged from the profiled external surface 300*b* of the wellhead 300.

Figure 5:
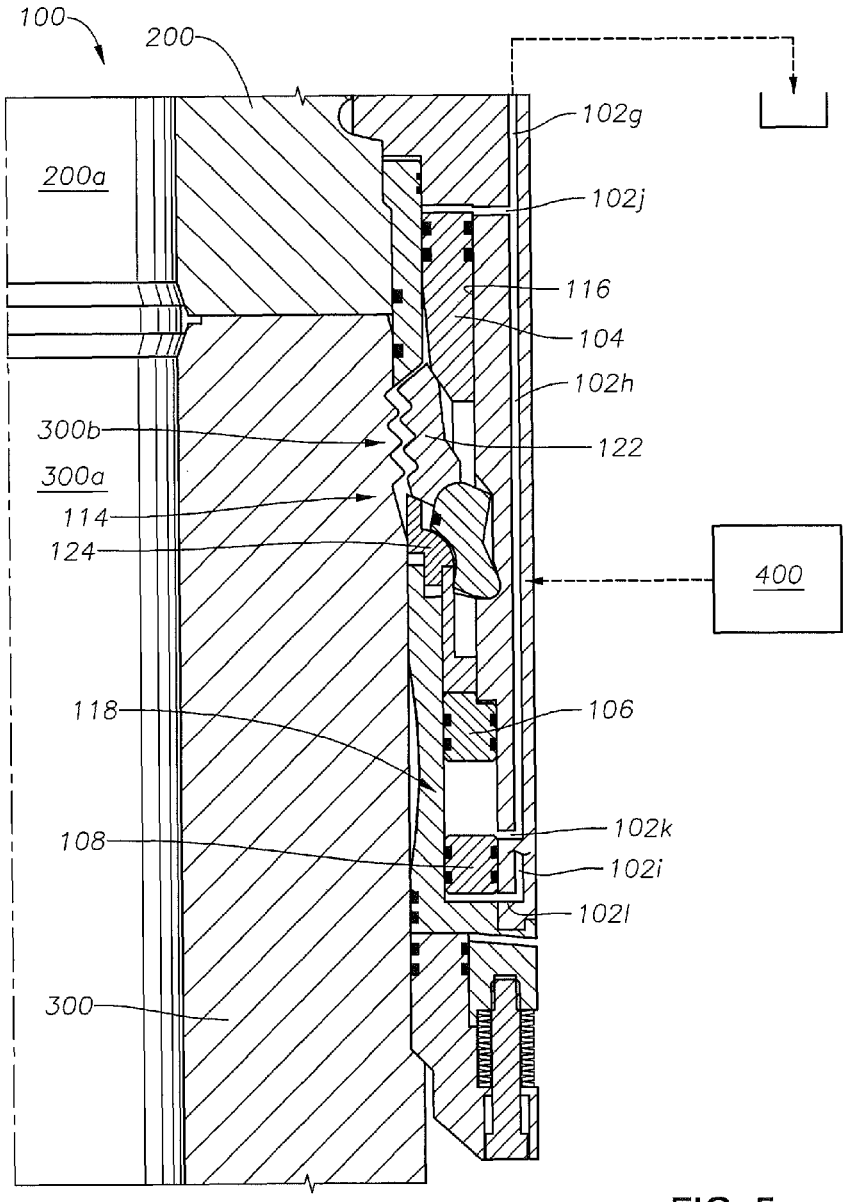
FIG. 5 is a fragmentary cross sectional illustration of an exemplary embodiment of the external hydraulic tieback connector of FIG. 3 during the unlocking of the connector from the wellhead.

Referring now to FIG. 5, in an exemplary embodiment, the locking dogs 122 may be disengaged from the profiled external surface 300*b* of the wellhead 300 by displacing the tubular actuating sleeve 104 upwardly relative to the locking dogs. In particular, the pump 400 may be operated to pump fluid into and through the passages, 102*h* and 102*k*, thereby pressurizing the portion of the annular chamber 118 below the tubular piston 106 and above the tubular piston 108. In an exemplary embodiment, during the pressurizing of the portion of the annular chamber 118 below the tubular piston 106 and above the tubular piston 108, fluid is drained from the annular chamber 116 through the passages, 102*g* and 102*j*.

As a result of the pressurizing of the portion of the annular chamber 118 below the tubular piston 106 and above the tubular piston 108, the tubular piston 106 and the tubular actuating sleeve 104 are displaced in an upward direction relative to the locking dogs 122 thereby permitting the locking dogs to be displaced radially outwardly through the annular window 114 out of engagement with the profiled external surface 300*b* of the wellhead 300. The upward displacement of the tubular actuating sleeve 104 further causes the inner surface of the tubular actuating sleeve to no longer surround and engage the outer surface of the locking dogs 122 thereby permitting the locking dogs from being disengaged from the profiled external surface 300*b* of the wellhead 300. In an exemplary embodiment, during the upward displacement of the tubular actuating sleeve 104, fluid is drained from the piston chamber 116 through the passages, 102*g* and 102*j*.

In an exemplary embodiment, once the locking dogs 122 have been disengaged from the profiled external surface 300*b* of the wellhead 300, the assembly 100 and liner 200 may be displaced upwardly relative to the wellhead 300.

As illustrated above in FIGS. 4 and 5, in an exemplary embodiment, during the upward displacement of the actuating sleeve 104, the upper end of the actuating sleeve engages the external annular recess 124*b* of the retraction sleeve 124 thereby displacing the retraction sleeve upwardly. As a result, the retraction sleeve 124 lifts and thereby displaces the locking dogs 122 into a retracted position out of engagement with the external profile 300*b* of the wellhead 300.

Figure 6:
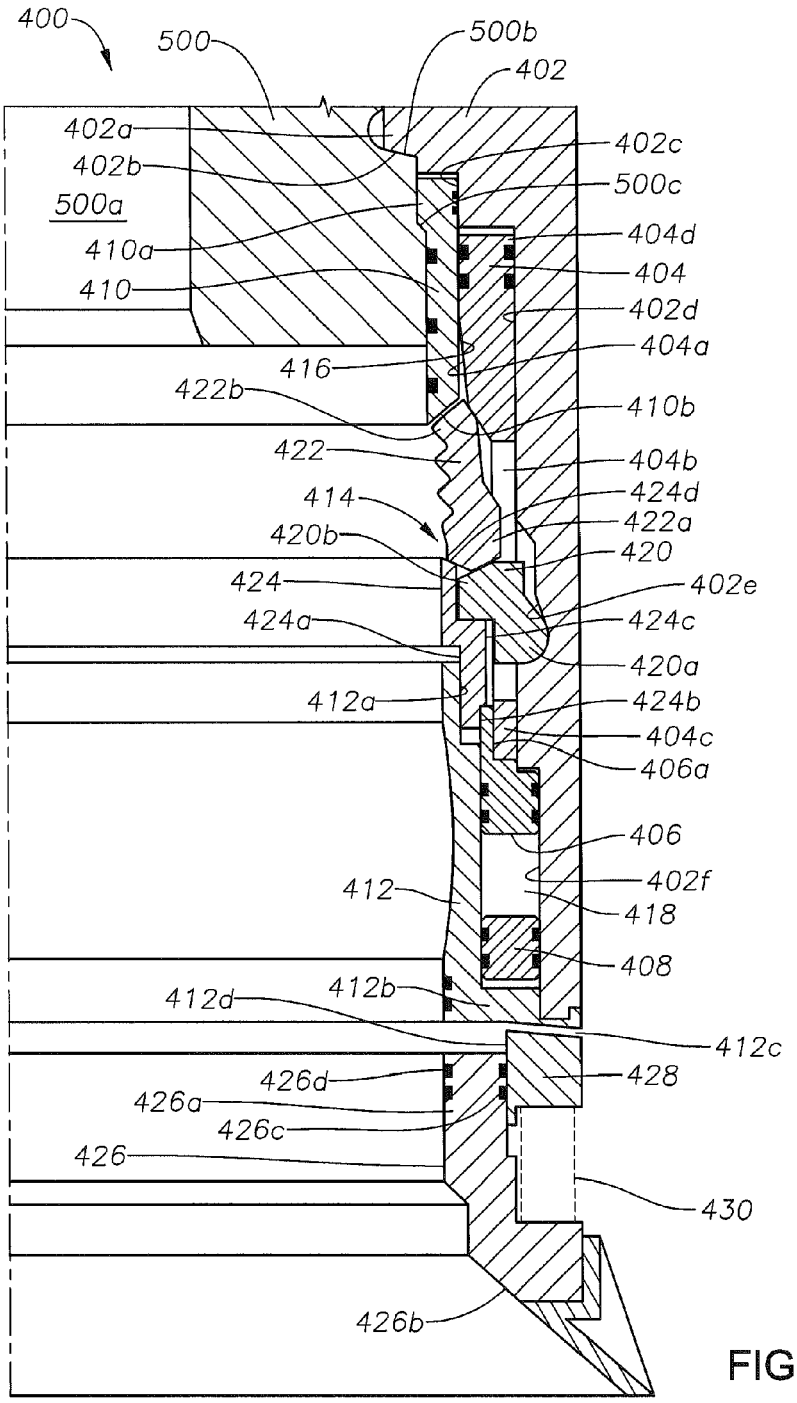
FIG. 6 is a fragmentary cross sectional illustration of an exemplary embodiment of an external hydraulic tieback connector.

Referring initially to FIG. 6, an exemplary embodiment of a tieback connector assembly 400 includes an outer tubular sleeve or housing 402 that includes an inner flange 402*a* at one end having a stepped internal shoulder 402*b*, an annular internal recess 402*c*, an annular internal recess 402*d*, an annular internal recess 402*e*, and an annular internal recess 402*f* at another end.

A tubular actuating sleeve 404, which is received within and mates with the annular internal recess 402*d* of the outer tubular sleeve 402 defines a tapered annular internal recess or can surface 404*a* on an inner side, a plurality of circumferentially spaced apart radial linking element windows 404*b*, and a lower tubular end 404*c* at another end. Actuating sleeve 404 is integrally joined to a setting piston 404*d* on its upper end.

A tubular retracting piston 406 that includes an annular external recess 406*a* at one end is received within and mates with the internal annular recess 402*f* of the outer tubular sleeve 402. In an exemplary embodiment, the external annular recess 406*a* of the tubular piston 406 mates with and is received within the internal annular recess 402*d* of the outer tubular sleeve 402 and the upper end of the tubular piston 406 is threadably coupled to the lower tubular end 404*c* of the tubular actuating sleeve 404.

A tubular piston 408 is received within and mates with the internal annular recess 402*f* of the outer tubular sleeve 402. The tubular piston 408 is also positioned proximate and below the tubular piston 406.

An inner tubular sleeve 410 includes an internal flange 410*a* at one end and an external tapered annular recess 410*b* at another end. The end of the inner tubular sleeve 410 is received within and mates with the annular internal recess 402*c* of the outer tubular sleeve 402.

An inner tubular sleeve 412 includes an external annular recess 412*a* at an upper end and an external flange 412*b* having flow passages 412*c* and an internal annular recess 412*d* at a lower end 428. The upper side of external flange 412*b* of the inner tubular sleeve 412 receives and mates with the lower end of the outer tubular sleeve 402.

The opposing ends of the inner tubular sleeves, 410 and 412, are spaced apart from one another and thereby define an annular locking dog window 414 therebetween.

The internal annular recess 402*d* of the external tubular sleeve 402 and the inner tubular sleeve 410 define therebetween an annular setting piston chamber 416 that receives setting piston 404*d* of the tubular actuating sleeve 404 for longitudinal displacement therein. The internal annular recess 402*f* of the external tubular sleeve 402 and the inner tubular sleeve 412 define therebetween an annular piston chamber 418 that receives the tubular retracting pistons, 406 and 408, for longitudinal displacement therein.

One side of a lower end 420*a* of a load transfer element or linking element 420 is received within the internal annular recess 402*e* of the external tubular sleeve 402. In an exemplary embodiment, a plurality of circumferentially spaced apart load transfer element elements 420 are received within the internal annular recess 402*e* of the external tubular sleeve 402. One side of an upper end 420*b* of each load transfer element 420 is received within the internal annular recess 402*e* of the external tubular sleeve 402. The other side of the upper end 420*b* of each load transfer element 420 extends through the corresponding circumferentially spaced apart radial linking element window 404*b* of the tubular actuating sleeve 404.

A lower end 422*a* of a locking dog 422 includes a surface that mates with an external surface of the upper end 420*b* of the load transfer element 420 for sliding motion relative thereto. In this manner, a plurality of circumferentially spaced apart locking dogs 422 are provided that are paired with a corresponding load transfer element 420. The lower end 422*a* of the locking dog 422 is also at least partially positioned within the corresponding circumferentially spaced apart radial window 404*b* of the tubular actuating sleeve 404 for movement therein. An upper end 422*b* of the locking dog 422 includes a tapered inner surface that mates with the tapered external annular recess 410*b* of the inner tubular sleeve 410 and a tapered outer surface that mates with the tapered annular internal recess 404*a* of the tubular actuating sleeve 404. An inner face of the locking dog 422 includes a profiled outer surface.

In an exemplary embodiment, the load transfer elements 420 and the locking dogs 422 may be staggered with respect to one another in a circumferential direction. As a result, each locking dog 422 may be supported by and paired with circumferential opposing end portions of adjacent load transfer elements 420.

A retraction sleeve 424 includes an internal annular recess 424*a* at one end that mates with the external annular recess 412*a* of the inner tubular sleeve 412, an external annular recess 424*b* at the one end that mates with and receives the other end of the tubular actuating sleeve 404, an outer external surface 424*c* that mates with complementary surfaces provided on each of the load transfer elements 420, and a tapered external surface 424*d* at another end that mates with a portion of the lower ends 422*a* of each of the locking dogs 422 for retaining and retracting the lower ends of the locking dogs.

An end of a telescoping tubular guide assembly or shock absorber assembly 426 is coupled to the other end of the inner tubular sleeve 412 that includes an inner telescoping tubular member 426*a* with a piston portion that mates with and is received within the internal annular recess 412*d* of the inner tubular sleeve 412 and includes a tapered opening 426*b* at a lower end thereof. The piston portion of tubular member 426*a* has annular inner seals 426*d* and outer seals 426*c*. Outer seals 426*c* seal against inner sleeve recess 412*d*. In an exemplary embodiment, the inner telescoping tubular member 426*a* of the tubular guide assembly 426 telescopes downwardly from the inner tubular sleeve 412 such that the inner telescoping tubular member 426*a* of the tubular guide assembly 426 may be displaced in a longitudinal direction relative to the inner tubular sleeve 412. Similar to as shown in FIGS. 1-5, the inner telescoping tubular member 426*a* of the tubular guide assembly 426 is coupled to the inner tubular sleeve 412 by one or more retaining bolts (not shown) and is spring biased away from the end of the inner tubular sleeve 412 by springs 430 positioned around each of the bolts.

Flow or displacement fluid passages 412*c* are also defined within and extend through the inner tubular sleeve 412 for conveying fluidic materials therethrough to inner annular recess 412*d*. In an exemplary embodiment, the flow passages 412*c* further include conventional orifices for controlling the rate of fluid flow therethrough.

In an exemplary embodiment, the design and operation of the tubular guide assembly 426 is substantially identical to the design and operation of the tubular guide assembly 126 illustrated and described above with reference to FIGS. 1-3.

During operation, as illustrated in FIG. 6, an upper end of the assembly 400 is coupled to a lower end of a conventional tubular liner 500 that defines an internal passage 500*a* and includes an external flange 500*b* at the lower end having a stepped external flange 500*c*. In particular, during assembly, the external flange 500*b* of the lower end of the liner 500 is received within and is coupled to the internal flange 402*a* of the external tubular sleeve 402 and the stepped external flange 500*c* of the lower end of the liner 500 is received within and is coupled to the internal flange 410*a* at the end of the inner tubular sleeve 410. In this manner, the lower end of the liner 500 is coupled to the upper end of the assembly 400 in such a manner as to prevent longitudinal displacement of the liner relative to the assembly. In an exemplary embodiment, the liner 500 provides an external riser for connection to a subsea wellhead.

Figure 7:
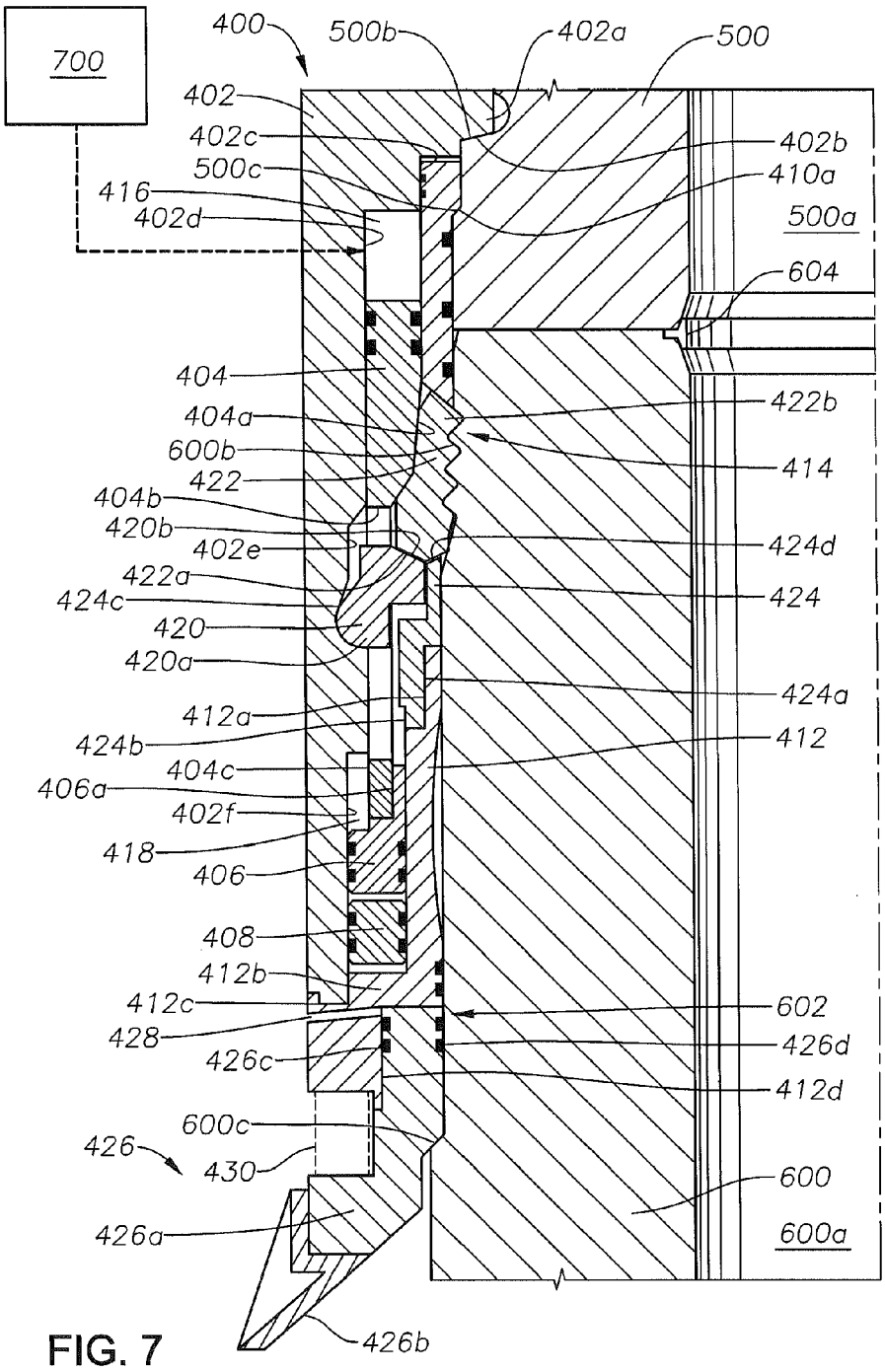
FIG. 7 is a fragmentary cross sectional illustration of an exemplary embodiment of the external hydraulic tieback connector of FIG. 6 during the locking of the connector onto the wellhead.

As illustrated in FIG. 7, after coupling the assembly 400 to the lower end of the liner 500, the assembly and liner are positioned proximate an end of a conventional wellhead 600 that defines an internal passage 600*a* and includes an external profiled surface 600*b* proximate the end of the wellhead. In an exemplary embodiment, the assembly 400 and liner 500 are then displaced toward the end of the wellhead 600 until the end of the wellhead is received within the tapered opening 426*b* of the tubular guide assembly 426. In an exemplary embodiment, the wellhead 600 is a subsea wellhead.

In an exemplary embodiment, as illustrated in FIG. 7, the assembly 400 and liner 500 are then further displaced toward the end of the wellhead 600 until the tapered opening 426*b* of the tubular guide assembly 426 engages load shoulders 600*c* provided on the wellhead. During the engagement of the tubular guide assembly 426 with the wellhead 600, an annular chamber 602 is defined by, and bounded between, the exterior surface of the wellhead and the axial annular space defined between the lower end face of the inner tubular sleeve 412 and the upper end face of the inner telescoping tubular member 426*a* of the tubular guide assembly 426.

In an exemplary embodiment, as illustrated in FIG. 7, after the tapered opening 426*b* of the tubular guide assembly 426 engages load shoulders 600*c* provided on the wellhead 600, the assembly 400 and liner 500 are then further displaced toward the end of the wellhead 600 until the lower end face of the liner rests on the upper end face of the end of the wellhead. As a result, a tubular gasket 604 is compressed between the opposing open ends of the liner 500 and wellhead 600 thereby sealing the interface therebetween. Furthermore, as a result of the further displacement of the assembly 400 and liner 500, the springs 430 of the tubular guide assembly 426 are compressed thereby permitting the inner tubular telescoping portion 426*a* of the tubular guide assembly 426 to telescope into and towards the inner tubular sleeve 412. Inner seals 426*d* seal against the exterior of wellhead 600 while outer seals 426*c* seal against inner sleeve 412 in chamber 602. As a result, sea water within the chamber 602 is exhausted out of the chamber through the passages 428 due to downward movement of inner sleeve 412 and outer sleeve 402 relative to telescoping guide member 426. In an exemplary embodiment, the combination of the springs 430, on the one hand, and the fluidic chamber 602 and passages 428, on the other hand, provide a spring-damper shock absorber system that controllably absorbs energy and limits the rate of displacement of the inner tubular telescoping portion 126*a* relative to the inner tubular sleeve 412 during the engagement of the guide assembly 426 with the wellhead 600.

In an exemplary embodiment, the energy absorbed by the springs, fluidic chamber 602 and passages 428, during the further displacement of the assembly 400 and liner 500 minimizes shock loads on the assembly 400, liner 500 and wellhead 600. Furthermore, as a result, energy absorbed by the springs, fluidic chamber 602 and passages 428, during the further displacement of the assembly 400 and liner 500 prevents damage to the gasket 604 thereby providing a soft landing of the end of the liner on the opposing end of the wellhead 600. Furthermore, as a result of the further displacement of the assembly 400 and liner 500, the locking dogs 422 of the assembly 400 are positioned in opposing relation to the profiled external surface 600*b* of the wellhead 600. Furthermore, as a result, energy absorbed by the springs, fluidic chamber 602 and passages 428, during the further displacement of the assembly 400 and liner 500 prevents distortion of the gasket 604 thereby preventing, for example, flattening of the vertically aligned portion of the gasket into engagement with the tapered open ends of the passages, 500*a* and 600*a*, of the liner 500 and wellhead 600, respectively.

The locking dogs 422 are then displaced into engagement with the profiled external surface 600*b* of the wellhead 600 thereby locking the lower end of the liner 500 onto the opposing end of the wellhead. In particular, a pump 700 may be operated to pump fluid into the annular chamber 416 thereby pressurizing the portion of the annular chamber 416 above the top end face of the tubular actuating sleeve 404.

As a result of the pressurizing of the portion of the annular chamber 416 above the top end face of the tubular actuating sleeve 404, the tubular actuating sleeve is displaced in a downward direction relative to the locking dogs 422 thereby impacting and displacing the locking dogs radially inwardly through the annular window 414 into engagement with the profiled external surface 600*b* of the wellhead 600. The downward displacement of the tubular actuating sleeve 404 further causes the inner surface of the tubular actuating sleeve to surround and engage the outer surface of the locking dogs 422 thereby preventing the locking dogs from being disengaged from the profiled external surface 600*b* of the wellhead 600. In an exemplary embodiment, during the downward displacement of the tubular actuating sleeve 404, fluid is drained from the piston chamber 418 through radial passages and longitudinal passages (not shown).

As illustrated in FIG. 7, during the operation of the assembly 400 to radially displace the locking dogs 422 into engagement with the profiled external surface 600*b* of the wellhead 600, the ends 422*a* of the locking dogs are supported on the ends 420*b* of the load transfer elements 420. In an exemplary embodiment, during the operation of the assembly 400 to radially displace the locking dogs 422 into engagement with the profiled external surface 600*b*, the locking dogs slide on the exterior surfaces of the ends 420*b* of the load transfer elements 420 into engagement with the profiled external surface 600*b* of the wellhead 600.

In an exemplary embodiment, the assembly 400 may be disengaged from the wellhead 600 by displacing the locking dogs 422 radially outward by displacing the tubular actuating sleeve 404 upwardly by pressurizing the annular chamber 418 using a pump. In this manner, one or both of the annular pistons, 406 and 408, may be displaced upwardly into engagement with the lower end of the tubular actuating sleeve 404 thereby displacing the tubular actuating sleeve upwardly and displacing the locking dogs 422 radially outward and out of engagement with the wellhead 600.

It is understood that variations may be made in the above without departing from the scope of the invention. Further, spatial references are for the purpose of illustration only and do not limit the specific orientation or location of the structure described above. While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

The invention claimed is:

1. A tie back liner connector assembly, comprising:

a tubular housing having a longitudinal axis and adapted to be coupled to the end of a liner, the tubular housing having at least one interior locking dog window;

a setting chamber in the housing;

an actuator carried in the housing for axial movement, the actuator having a setting piston within the setting chamber, a cam surface, and an actuating sleeve extending from the setting piston;

a retraction chamber in the housing, spaced axially from the setting chamber and having a retracting piston therein;

locking dogs movably coupled to the tubular housing for displacement through the at least one locking dog window of the tubular housing, the locking dogs being axially spaced between the setting chamber and the retraction chamber, the locking dogs being in engagement with the cam surface;

the actuating sleeve having a plurality of linking element windows, the actuating sleeve having a lower end portion extending into the retraction chamber in engagement with the retracting piston;

a plurality of linking elements, each having an inner end in engagement with one of the locking dogs and an outer end in engagement with a load shoulder located in the housing, the inner and outer ends being axially spaced from each other for transferring forces on the locking dogs to the housing, the linking elements extending through the linking element windows in the actuating sleeve; and wherein applying fluid pressure to the setting chamber moves the setting piston, the actuating sleeve and the retracting piston in one direction to move the dogs radially inward into a setting position in engagement with a profiled surface on a wellhead, and applying fluid pressure to the retraction chamber moves the retracting piston, the actuating sleeve and the setting piston in an opposite direction to release the locking dogs from engagement with the profiled surface on the wellhead.

2. The assembly of claim 1, wherein the inner end of each of the linking elements comprises a straight conical surface that appears flat when viewed in cross section.

3. The assembly of claim 1, further comprising a shock absorbing sleeve coupled to an end of the housing for axial movement of the shock absorbing sleeve relative to the housing, the shock absorbing sleeve adapted to land on a landing shoulder of the wellhead; and a spring located between the shock absorbing sleeve and the housing to absorb shock when the sleeve lands on the landing shoulder of the wellhead.

4. The assembly of claim 3, wherein:

said end of the housing has a recess that faces an exterior portion of the wellhead when the connector assembly has landed on the wellhead, defining a shock absorbing chamber;

the shock absorbing sleeve has a piston portion carried in the shock absorbing chamber; and the shock absorbing sleeve has an inner seal on an inner side of the piston portion that is adapted to slidingly engage the exterior portion of the wellhead, and an outer seal on an outer side of the piston portion that slidingly engages the recess.

5. The assembly of claim 4, further comprising:

a port extending laterally from the shock absorbing chamber to an exterior of the housing to allow trapped fluid in the shock absorbing chamber to be displaced when the housing moves axially relative to the shock absorbing sleeve while the tieback connector is landing on the wellhead.

6. A tie back liner connector assembly, comprising:

a tubular housing having a longitudinal axis and adapted to be coupled to the end of a liner;

a tubular inner sleeve rigidly mounted within the housing, the inner sleeve having a plurality of locking dog windows;

a plurality of locking dogs movably coupled to the tubular housing, within the locking dog windows for engagement with an external profiled surface of a wellhead;

a setting piston chamber located between the inner sleeve and an inner wall of the housing;

a retracting piston chamber located between the inner sleeve and the inner wall of the housing and having a retracting piston;

an axially movable actuator having a setting piston and an actuator sleeve extending therefrom, the setting piston being located in the setting piston chamber, the actuator sleeve having one end extending into the retracting piston chamber into engagement with the retracting piston, the actuator having an intermediate cam portion axially spaced between the setting and retracting pistons and located laterally outward and in contact with outer sides of the locking dogs;

a plurality of linking elements, each having an inner end in engagement with one of the locking dogs and an outer end in engagement with a load shoulder provided in the inner wall of the housing, the inner and outer ends of the linking elements being axially spaced from each other;

a plurality of linking element windows in the actuator sleeve between the setting and retracting pistons; wherein each of the linking elements extends through one of the linking element windows; and fluid pressure applied to the setting piston chamber axially moves the setting piston, the actuator sleeve, and the retracting piston in one direction to move the locking dogs inward into engagement with the profiled surface of the wellhead, and fluid pressure applied to the retracting piston chamber moves the retracting piston, the actuator sleeve, and the setting piston in an opposite direction to release the locking dogs from engagement with the profiled surface of the wellhead.

7. The assembly of claim 6, wherein the inner end of each of the linking elements is a straight conical surface that appears flat when viewed in cross section.

8. The assembly of claim 6, further comprising a shock absorber sleeve coupled to a lower end of the housing and having a downward facing internal shoulder for landing on a landing shoulder of a wellhead, the shock absorber sleeve being axially movable relative to the housing for absorbing shock when the connector assembly lands on the wellhead; and a spring between the shock absorber sleeve and the housing for urging the shock absorber sleeve downward relative to the housing.

9. The assembly of claim 8, wherein the shock absorber sleeve has an outward flared lower end.

10. The assembly of claim 8, wherein:

a recess is located in the lower end of the housing that defines a shock absorbing chamber when the lower end of the housing is located on the wellhead; and the shock absorbing sleeve has a piston portion located in the shock absorbing chamber, the piston portion of the shock absorbing sleeve having an inner seal adapted to seal against the wellhead and an outer seal that seals against the recess.

11. The assembly of claim 10, further comprising a displacement port extending through the housing from the recess to an exterior of the housing.

12. A tie back liner connector assembly, comprising:

a tubular housing having a longitudinal axis and adapted to be coupled to the end of a liner;

an inner sleeve fixedly mounted within the housing, defining an annular space between an exterior side of the inner sleeve and the housing;

a plurality of locking dog windows defined by the inner sleeve;

a plurality of locking dogs movably mounted in the locking dog windows and being movable laterally inward within the locking dog windows into engagement with an external profiled surface of a wellhead;

an actuator carried for axial movement within the annular space between the inner sleeve and the housing, the actuator having a setting piston that seals between the exterior side of the inner sleeve and the housing in the annular space;

a retracting piston sealing between the exterior of the inner sleeve and the housing in the annular space, the locking dog windows being located axially between the setting piston and the retracting piston, the actuator having an actuator sleeve extending from the setting piston and carried in the annular space, the actuator sleeve having an intermediate portion extending laterally outward from the locking dog windows, the actuator sleeve having a lower end portion in engagement with the retracting piston;

a cam surface on an inner side of the intermediate portion of the actuator sleeve for pushing the locking dogs laterally inward in response to fluid pressure applied to the setting piston moving the setting piston and the actuator sleeve downward;

a retracting sleeve in engagement with the retracting piston and being axially movable upward in response to fluid pressure delivered to the retracting piston for pushing the locking dogs laterally outward;

a plurality of linking elements, each having an inner end that engages one of the locking dogs and an outer end that engages a load shoulder provided in the housing for transferring loads from the locking dogs to the tubular housing; and wherein the intermediate portion of the actuator sleeve has a plurality of linking element windows through which the linking elements extend.

13. The assembly of claim 12, wherein the retracting sleeve is located radially inward from the intermediate portion of the actuator sleeve.

14. The assembly of claim 12, wherein the inner end of each of the linking elements is a straight conical surface that appears flat when viewed in cross section.

15. The assembly of claim 12, wherein the setting piston and the retracting piston move axially in unison with each other.

16. The assembly of claim 12, wherein:

the housing has an inner shoulder that defines one end of the annular space that is abutted by the setting piston when the actuator is in a released position; and the inner sleeve has an outer shoulder that defines an opposite end of the annular space.

17. A tie back liner connector assembly, comprising:

a tubular housing having a longitudinal axis and adapted to be coupled to the end of a liner;

one or more locking elements movably coupled to the tubular housing adapted for displacement thereto into engagement with an external profiled surface of a subsea wellhead; and a shock absorber assembly coupled to a lower end of the housing, having a shock absorber sleeve with an internal downward facing internal shoulder adapted to land on an external landing shoulder of the wellhead, the shock absorber sleeve being axially movable relative to the housing, and the shock absorber assembly having a spring located between the shock absorber sleeve and the lower end of the housing for absorbing shock when the shock absorber sleeve lands on the landing shoulder of the wellhead.

18. The assembly of claim 17, further comprising:

an actuator operably coupled to the tubular housing for displacing the locking elements relative to the tubular housing to engage the external profiled surface of the wellhead.

19. The assembly of claim 17, wherein the shock absorber assembly further comprises:

a damper chamber defined between the housing and the wellhead when the connector is landing on the wellhead, the damper chamber adapted to be in communication with sea water surrounding the wellhead; and wherein the shock absorber sleeve has a piston portion within the damper chamber to dampen axial movement of the housing after the shock absorber sleeve lands on the landing shoulder.

20. The assembly of claim 19, further comprising a flow passage extending from the damper chamber for controllably permitting sea water to be exhausted from the damper chamber when the housing moves axially relative to the shock absorber sleeve after the shock absorber sleeve has landed on the landing shoulder.

21. The assembly of claim 19, wherein the damper chamber is defined on an inner side by the wellhead and on an outer side by the housing.

22. The assembly of claim 21, wherein the shock absorber sleeve has an inner seal that seals against the wellhead.

* * * * *